United States Patent [19]

Dysart et al.

[11] 4,154,313

[45] May 15, 1979

[54] FLOW CONTROL VALVE FOR ROCK BITS

[75] Inventors: Theodore R. Dysart, Dallas, Tex.; Don C. McKay, Rush Springs, Okla.

[73] Assignee: Dresser Industries, Inc., Dallas, Tex.

[21] Appl. No.: 901,057

[22] Filed: Apr. 28, 1978

[51] Int. Cl.[2] ..... E21B 9/08

[52] U.S. Cl. ..... 175/318; 175/337

[58] Field of Search ..... 175/227, 318, 337; 308/8.2

[56] References Cited

U.S. PATENT DOCUMENTS

| | | | |
|---|---|---|---|
| 3,125,174 | 3/1964 | Medlock et al. | 175/337 |
| 3,268,018 | 8/1966 | Neilson | 175/318 |
| 3,401,758 | 9/1968 | Talbert | 175/318 |
| 3,534,823 | 10/1970 | Frederick | 175/337 |
| 4,092,054 | 5/1978 | Dye | 175/337 |

FOREIGN PATENT DOCUMENTS

| | | | |
|---|---|---|---|
| 185300 | 12/1966 | U.S.S.R. | 175/337 |
| 303409 | 1/1971 | U.S.S.R. | 175/318 |

*Primary Examiner*—James A. Leppink
*Attorney, Agent, or Firm*—Eddie E. Scott

[57] ABSTRACT

A rotary rock bit with passageways for conducting air or other gaseous fluid to cool the bearings and flush cuttings from the borehole includes valve means for controlling the entry of water into the bearings. The stream of air or other gaseous fluid is directed through a valve system that prevents water from reaching the bearings. In one embodiment a truly positive backflow shutoff valving arrangement through both the nozzle and bearing passageways provides a means for more effectively preventing water and cuttings from entering the bearings and bearing passageways of the bit.

2 Claims, 5 Drawing Figures

FLOW CONTROL VALVE FOR ROCK BITS

BACKGROUND OF THE INVENTION

The present invention relates to the earth boring art and more particularly to a rotary drill bit with structure for preventing liquid in the borehole from contacting and damaging the bearings of the bit. The bit of this invention is generally used to drill mining and blast holes and the like by the rotary drilling method. In the drilling of such earth bores, air or other gaseous fluid is used as the medium for cooling the bit and for carrying cuttings from the bottom of the hole or well bore to the surface. The fluid is displaced downwardly through the interior of a rotary drill string to the drill bit. The fluid passes through the drill bit and then upwardly through the annular space between the drill string and the wall of the well bore carrying with it the drill cuttings.

In the blast hole drilling industry there has long been a need for backflow shutoff valving inside the bit which will prevent water and cuttings from flowing into the bit body and clogging the nozzles and bearing air passageways whenever there is a loss of circulating air flow. When a water producing zone or formation has been encountered, stopping the air circulation permits water to rise in the well bore. As the water rises, it can flow upwardly through the drill bit and into the interior of the drill string. Loose cuttings formed during the drilling operation are frequently carried with the water into the drill string and bit. When drilling is resumed the air circulation will be restarted. The cuttings contained in the water may plug the cooling passageways in the bit and restrict air flow. Under such circumstances air is prevented from reaching the bit bearings, resulting in overheating and softening of the bearings thereby destroying the usefulness of the bit. When this occurs, it is necessary to remove the drill string from the well and replace the bit. Such a procedure is time consuming and very expensive.

Due to the extreme weights exerted on the drill bits, considerable heat is generated in the bearings. It is therefore essential that a constant and substantial flow of air be maintained through the bearings to prevent overheating and its attendant problems. Generally, air drilling bits are constructed with one of two types of flow passageways. In one, which is generally referred to as a regular bit, the main stream of air utilized to carry the cuttings from the bottom of the well bore passes through a central opening extending through the drill bit. A plurality of cooling passageways extend from the central opening to a point adjacent the bearings of the bit for the purposes of cooling the bearings. In the other, which is referred to as a jet type bit, the air stream for carrying cuttings from the bottom of the well bore enters a central recess in the bit and exits therefrom through three jet passageways. The air passes through orifices located in the jet passageways forming relatively high velocity streams directed to engage the bottom of the well bore between the cutting members of the bit. A plurality of cooling passageways extend from the central recess to a point adjacent the bearings of the bit for the purpose of cooling the bearings. The present invention may be employed with either the regular bit or the jet bit.

DESCRIPTION OF PRIOR ART

Although there are prior art devices that have been developed to shut off backflow of water, a need to provide even better devices exists if the art of drilling is to be advanced. Two specific examples of the prior art systems will now be reviewed. They are Talbert U.S. Pat. No. 3,401,758 assigned to Dresser Industries and Hollingshead U.S. Pat. No. 3,685,601 assigned to Reed Tool Company.

The Hollingshead patent describes individual nozzles that are fitted with non-return flapper assemblies that control backflow into the body of the bit immediately at the exit point of the air jet stream into the borehole. The Talbert patent describes a device that controls the backflow inside the bit body. The bit body may partially fill with water and cuttings that, it is hoped, will be expelled when the air is restarted. This latter device is placed in the bit body so that it is downstream of the interior air passageways to the bearing thus protecting the air passageways from the contaminated fluid entering the bit body through the nozzles.

Both of these devices presume that a minimum of water and cuttings will enter the bearings through the tight clearances at the cone mouth. This presumption is questioned by Applicant since blast hole bit bearings retain their factory tight clearances for only a short time after the bit is put into service, and in actuality are operating throughout most of their usefulness with bearing clearances due to wear of component parts that are far greater than intended by the bit designer. This bearing wear creates interior clearances. Water and cuttings are believed to penetrate the bearing cavities when positive air pressure inside the bit is reduced. The Talbert and Hollingshead valves cannot prevent this infiltration because, as mentioned, the valves shut off backflow into the nozzle cavities only. The air passageways remain open, connecting the bearing to the central bore of the bit body at points intersecting the bore upstream from the locations of either of these valves. The bearings may become filled with fine cuttings. When drilling is resumed and the air is restarted, the cuttings flow out of the large passageways to the nozzles fairly easily but may not blow out of the small air passageways to the bearings. This results in permanently blocked air passageways to bearings with the end result being overheating and ultimate failure.

It is clear that a device that will impede fluid backflow through all passageways, i.e., nozzle bores, bearing cavities and drilled air passageways in a blast hole bit is a desirable and advantageous improvement. Many prior art patents are directed to systems for protecting the bearings of drill bits to prevent the bearings from becoming contaminated and damaged by water or other fluids. A summary of the development of this prior art indicates that while a substantial amount of early work was undertaken, the art appears to have become stagnant during recent times. Accordingly, in order to advance the state of the art a need clearly exists for improvements over prior art systems and the improvement of drilling bits. The following table sets out a summary of a general survey conducted by applicant of the prior art patents relating to this type of system.

| Pat. No. | Title | Date |
|---|---|---|
| U. S. Pat. No. 2,293,259 | Device for Preventing Clogging of Drilling Bits | 8-18-42 |
| U. S. Pat. No. 2,329,745 | Means for Protecting Bearings of Roller Bits | 9-21-43 |
| U. S. Pat. No. 2,661,932 | Roller Cutter Bit With Fluid Flushing Bearings | 12-8-53 |

-continued

| Pat. No. | Title | Date |
|---|---|---|
| U. S. Pat. No. 2,751,196 | Rotary Bit For Dry Rock Drilling | 6-19-56 |
| U. S. Pat. No. 2,783,971 | Apparatus for Earth Boring With Pressurized Air | 3-5-57 |
| U. S. Pat. No. 2,814,464 | Air Course Drill Bits | 11-26-57 |
| U. S. Pat. No. 2,861,780 | Means for Cooling the Cutters of Drill Bits | 11-25-58 |
| U. S. Pat. No. 2,880,970 | Water Lubricated Bit | 4-7-59 |
| U. S. Pat. No. 2,920,872 | Water Separator For Air Drilling | 1-12-60 |
| U. S. Pat. No. 3,094,175 | Oil Drilling Apparatus and Method | 6-18-63 |
| U. S. Pat. No. 3,105,563 | Apparatus for Drilling Holes in Underground Formations | 10-1-63 |
| U. S. Pat. No. 3,125,174 | Rock Bit With Replaceable Air Course | 3-17-64 |
| U. S. Pat. No. 3,125,175 | Rock Bit With Replaceable Air Course | 3-17-64 |
| U. S. Pat. No. 3,198,267 | Method and Apparatus for Controlling Dust in a Rotary Drilling Operation | 4-3-65 |
| U. S. Pat. No. 3,268,018 | Air or Gas Circulation Rock Bit Anti-Contamination Valve | 8-23-66 |
| U. S. Pat. No. 3,401,758 | Flow Control Valve For Jet Drilling | 9-17-68 |
| U. S. Pat. No. 3,685,601 | Drill Bit | 8-22-72 |
| U. S. Pat. No. 3,788,408 | Rock Bit Water Deflector and Separator | 1-29-74 |
| U. S. Pat. No. 3,990,525 | Sealing System for a Rotary Rock Bit | 11-9-76 |

SUMMARY OF THE INVENTION

The present invention provides a drill bit with means for preventing water or other liquids from entering the bearings of the bit. This allows only the circulating drilling fluid to enter the bearings. The drilling fluid is directed through a valve system that prevents water from reaching the bearings. A backflow shutoff valving arrangement provides a means for more effectively preventing water and cuttings from entering the bearings and bearing passageways of the bit. The above and other features and advantages of the present invention will become apparent from a consideration of the following detailed description of the invention when taken in conjunction with the accompanying drawings.

DETAILED DESCRIPTION OF THE INVENTION

Figure 1:
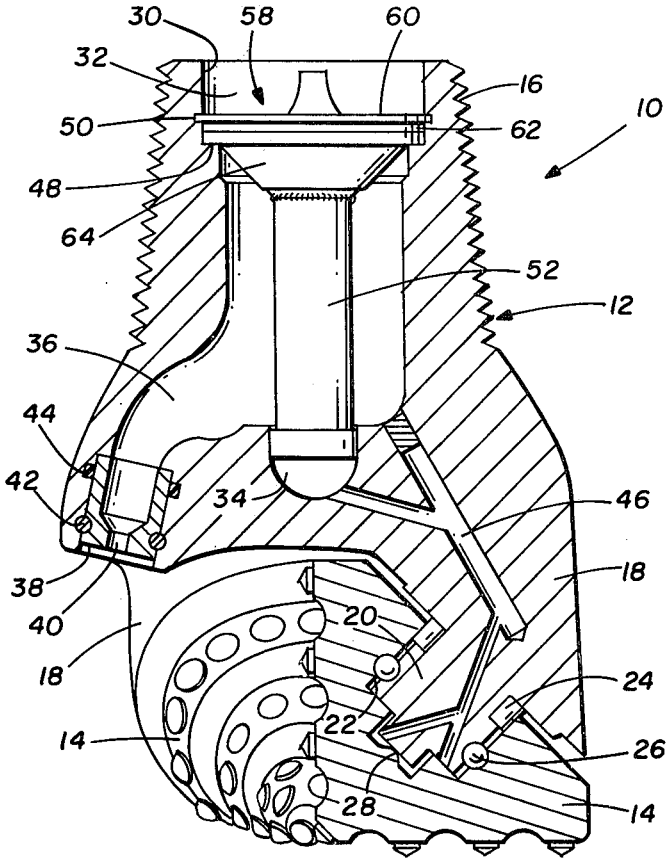
FIG. 1 is a cut-away view of a blast hole bit incorporating one embodiment of the present invention.

Referring to the drawings and to FIG. 1 in particular, shown therein and generally designated by the reference character 10 is a jet type blast hole bit constructed in accordance with the invention. The bit 10 includes a body 12 and a plurality of cutters 14 journaled on the body 12. The body 12 is threaded at 16 for connection with the lower end of a rotary drill string (not shown). The body 12 also includes a depending arm 18 for each of the cutters 14. Each of the arms 18 is provided with a spindle 20 that projects into a recess 22 formed in each of the cutters 14. The cutters 14 are rotatably mounted on the spindles 20 by roller bearings 24, ball bearings 26, and other suitable load bearing surfaces such as the thrust button 28.

The body 12 includes a centrally located recess 30 that is divided into an upper chamber 32 and a lower chamber 34. A plurality of jet passageways 36 extend downwardly through the body 12. The lower ends of the jet passageways 36 are located between adjacent cutters 14. Located in the lower end of each of the jet passageways 36 is an orifice member 38. It will be noted that the orifice members 38 are provided with a small opening or orifice 40 so that the velocity of the fluid flowing through the passageways 36 is increased. Each orifice member 38 is retained in a respective one of the passageways 36 by a lock member 42. An O-ring seal 44 encircles each orifice member 38 forming a fluid tight seal between each orifice member 38 and the body 12.

A plurality of cooling passageways 46 extend through the body 12 intersecting the lower chamber 34 and terminating adjacent the various bearing surfaces of the spindle 20. The cooling passageways 46 are provided to direct a portion of the circulating air or gas utilized in the drilling process into the bearing surfaces for the purpose of cooling the bearings. The present invention provides valve means for controlling the entry of water into the bearings. The stream of air or gas is directed through a valve system to prevent water from reaching the bearings. A truly positive backflow shutoff valving arrangement through both the nozzle 36 and bearing passageways 46 provides a means for more effectively preventing water and cuttings from entering the bearings and bearing passageways of the bit.

Figure 2:
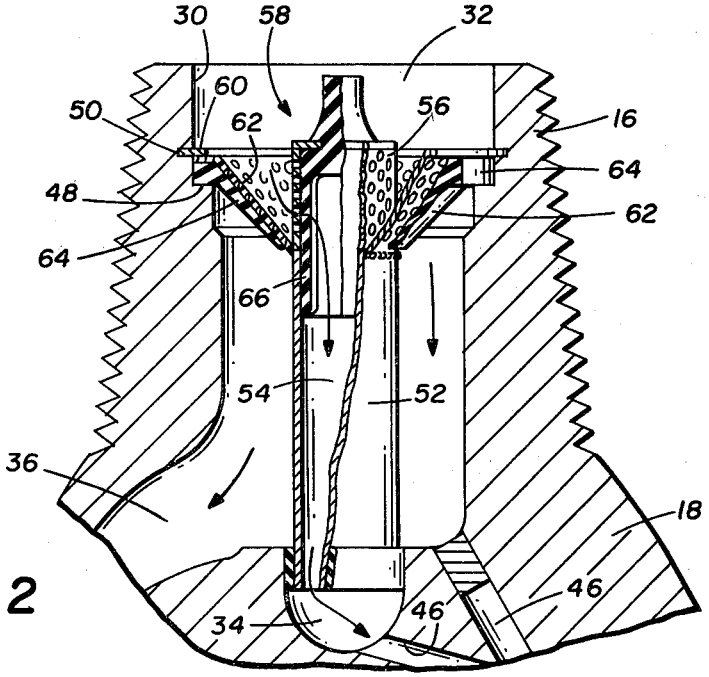
FIG. 2 is an enlarged view of the valving arrangement of the bit shown in FIG. 1.

Referring now to FIG. 2, an enlarged and more detailed illustration of the valving arrangement is shown. The body 12 of the bit 10 has an upwardly facing shoulder 48 encircling the recess 30 in the upper chamber 32. An annular groove 50 also encircles the recess 30, above the shoulder 48 and in spaced relation thereto. A centrally located hollow member 52 has its lower end disposed in the lower chamber 34 and has an interior 54 in communication with the cooling passageways 46 through the lower chamber 34. The lower end of the hollow member 52 is in sealing engagement with the body 12. The upper end of the hollow member 52 is provided with a perforated cap 56. The cap 56 provides a screen to prevent the entrance of relatively large particles into the interior 54 of the hollow member 52.

An assembly, generally designated by the reference character 58, is located in the recess 30 of the bit body 12 and is retained therein by a lock ring 60 that is disposed in the annular groove 50. The assembly 58 includes a perforated member 62 that is connected with the hollow member 52 between the cap 56 and the lower end thereof. The perforated member 62 is frusto-conical in configuration having its inner periphery attached to the hollow member 52 and having its outer periphery disposed in engagement with the lock ring 60. A resilient member 64, which is also frusto-conical in configuration, is disposed in juxtaposition with the lower surface of the perforated member 62. The outer periphery of the resilient member 64 is disposed in engagement with the annular shoulder 48 and the body 12. The resilient member 64 includes a plurality of circumferentially spaced lacerations that extend radially from the inner periphery toward the outer periphery thereof. The lacerations form a plurality of leaves that are relatively easily deformed or moved away from the perforated member 62 by fluid flowing downwardly through the upper chamber 32 in the bit 10. The leaves being resilient will be returned into engagement with the lower surface of the perforated member 62. This will close the perforations in member 62 due to flow of any fluid upwardly in the recess 30. A resilient member 66 is positioned within the perforated cap 56. The resilient member 66 is easily deformed or moved away from the perforated cap 56 by fluid flowing downwardly through the upper chamber 32 in the bit 10. Any flow in the opposite direction will cause the resilient member 66 to close the perforations in perforated cap 56 and block flow of any fluid upwardly.

The structural details of a bit 10 constructed in accordance with the present invention having been described the operation of the bit 10 will now be considered. The assembly 58 and hollow member 52 are inserted into the recess 30 in the body 12 until the resilient member 64 engages the upwardly facing shoulder 48 and the hollow member 52 is secured in the lower chamber 34. The lock ring 60 is then inserted to secure the assembly 58 and the hollow member 52 in the body 12. The bit 10 is connected by the threads 16 to the lower end of a rotary drill string (not shown). The bit and drill string are lowered into the well bore (not shown) and rotated forcing the cutters 14 into cutting engagement with the bottom of the well bore.

Drilling fluid, for example air, is circulated downwardly through the drill string into the recess 30. The air passes through the perforations in cap 56 deforming resilient member 66. The air continues into the interior 54 of the hollow member 52 to the cooling passageways 46 and the various bearings journaling the cutters 14 on the spindles 20. It should be emphasized that the central location of the hollow member 52 places it in the center of the air stream wherein the air velocity is at a maximum. Such a location assures that the bearings will receive the optimum quantity of cooling air. Also, a portion of the air passes through the perforations in the perforated member 62 into the jet passageways 36, deforming the leaves of the resilient member 64 downwardly. The air exiting from the jet passageways 36 passes through the orifices 40 and is directed to the bottom of the well bore. The circulating air entrains the cuttings from the well bore and carries them upwardly between the wall of the well bore and the exterior of the bit 10 and drill string (not shown).

If a water bearing formation has been encountered during the drilling of the borehole, the water migrates into the well bore when the circulation of the air ceases. When this occurs, the water rises in the borehole and completely surrounds the bit 10. If the water was not otherwise restricted it would pass upwardly through the orifices 40 and the jet passageways 36 into the upper chamber 32 of the recess 30. Simultaneously, water would migrate through the journals of the cutters 14, passing upwardly through the cooling passageways 46 into the interior 54 of the hollow member 52. The present invention provides means for preventing this water from entering the bearings of the bit. A positive backflow shutoff valving arrangement through both the nozzle and bearing passageways provides a means for more effectively preventing water and cuttings from entering the bearings and bearing passageways of the bit. The rubber bladder seal/valve system provides a flow control valve to prevent the flow of water into the bit 10. When the circulating air is turned off, the pressure within the bit 10 drops. The borehole pressure being greater than the pressure within the bit 10 tends to move water and cuttings into the nozzle and bearing cavities. The borehole pressure forces the two resilient members 64 and 66 to seal off the water. Since the borehole pressure is greater than the pressure within the bit 10, due to the head of ground water in the borehole, the seal against the perforated elements 56 and 62 is strong and sufficiently effective to seal off passage of air back into the upper cavity 32 of the bit thus creating air pockets that will contain and prevent the ground water from entering the nozzle and bearing cavities. It is expected that some small amount of water and cuttings would enter the lower extremities of the nozzle and bearing cavities, but with positive air seals on all the openings into the bit this encroachment should be minor and easily expelled when the circulating air is restarted.

Figure 3:
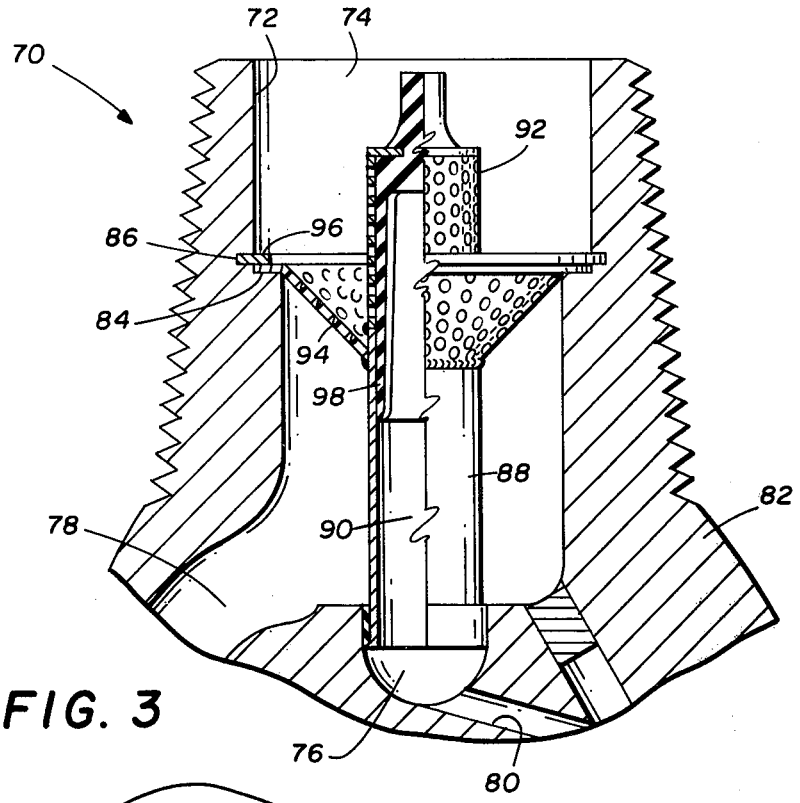
FIG. 3 illustrates another embodiment of a bit constructed according to the present invention.

Referring now to FIG. 3, a second embodiment of a bit constructed in accordance with the present invention is illustrated. The bit is generally designated by the reference character 70. The bit 70 includes a centrally located recess 72 that is divided into an upper chamber 74 and a lower chamber 76. A plurality of jet passageways 78 extend downwardly through the body 82. The lower ends of the jet passageways 78 are located between adjacent cutters. A plurality of cooling passageways 80 extend through the body 82 intersecting the lower chamber 76 and terminating adjacent the various bearing surfaces of the spindle. The cooling passageways 80 are provided to direct a portion of the circulating air or gas utilized in the drilling process into the bearing surfaces for the purpose of cooling the bearings.

The body 82 of the bit 70 has an upwardly facing shoulder 84 encircling the recess 72 in the upper chamber 74. An annular groove 86 also encircles the recess 72 above the shoulder 84 and in spaced relation thereto. A centrally located hollow member 88 has its lower end disposed in the lower chamber 76 and has an interior 90 in communication with the cooling passageways 80 through the lower chamber 76. The lower end of the hollow member 88 is in sealing engagement with the body 82. The upper end of the hollow member 88 is provided with a perforated cap 92. This provides a screen to prevent the entrance of relatively large pieces into the interior 90 of the hollow member 88. A perforated member 94 is positioned around the hollow member 88. The perforated member 94 is frusto-conical in configuration having its inner periphery attached to the hollow member and having its outer periphery disposed in engagement with a lock ring 96. The perforated member thus provides a screen to prevent the entrance of relatively large particles into the jet passageways 78. A resilient member 98 is positioned within the perforated cap 92. The resilient member 98 is easily deformed or moved away from the perforated cap 92 by fluid flowing downwardly through the upper chamber 74 in the bit 70. Any flow in the opposite direction will cause the resilient member 98 to close the perforations in perforated cap 92 and block flow of any fluid upwardly.

The structural details of a second embodiment of a bit constructed in accordance with the present invention having been described, the operation of the bit 70 will now be considered. After the perforated members 92 and 94 and hollow member 88 are assembled, they are inserted into the recess 74 in the body 82 until the screen 94 engages the upwardly facing shoulder 84. The lock ring 96 is then inserted to secure the perforated member 94 and hollow member 88 in the body 12. The bit 70 is connected to the lower end of a rotary drill string (not shown). The bit 70 and drill string are lowered into the well bore (not shown) and rotated by the drill string forcing the cutters into engagement with the bottom of the borehole. Drilling fluid is circulated downwardly through the drill string into the recess 72. The air passes through the perforations in cap 92 deforming the resilient member 98. The air continues into the interior 90 of the hollow member 88 to the cooling passageways 80 and the various bearings journaling the cutters on the spindles. It should be emphasized that the central location of the hollow member 88 places it in the center of the air stream wherein the air velocity is at a maximum. Such a location insures that the bearings will receive the optimum quantity of cooling air. Also, a portion of the air passes through the perforations in the perforated member 94 into the jet passageways 78. The air exiting from the jet passageways pass through the nozzles and is directed to the bottom of the well bore. The circulating air entrains the cuttings from the well bore and carries them upwardly between the wall of the well bore and the exterior of the bit and the drill string.

The present invention provides valve means for controlling the entry of water into the bearings. The stream of air or gas is directed through a valve system to prevent water from reaching the bearings. A shut-off valving arrangement through the bearing passageways provides a means for more effectively preventing water and cuttings from entering the bearings and bearing passageways of the bit. If a water bearing formation has been encountered during the drilling of the borehole, the water migrates into the well bore when the circulation of air ceases. When this occurs, the water rises in the well bore and completely surrounds the bit. If the water was not otherwise restricted, it would migrate through the journals of the cutters passing upwardly through the cooling passageways into the interior of the hollow member. The rubber bladder seal/valve assembly provides a flow control valve to prevent the flow of water into the bit. When the circulating air is turned off the pressure within the bit drops. The borehole pressure being greater than the pressure within the bit tends to move water and cuttings into the bearing cavities. The borehole pressure forces the resilient member 98 to seal off the water. Since the borehole pressure is greater than the pressure within the bit 70 due to the head of ground water in the borehole, the seal against the perforated element 92 is strong and sufficiently effective to seal off passage of air back into the bit thus creating air pockets that will contain and prevent the ground water from entering the bearing cavities. It is expected that some small amount of water and cuttings may enter the lower extremeties of the bearing cavities, but with positive air seals on all the openings into the bit this encrouchment should be minor and easily expelled when the circulating air is restarted.

Figure 4:
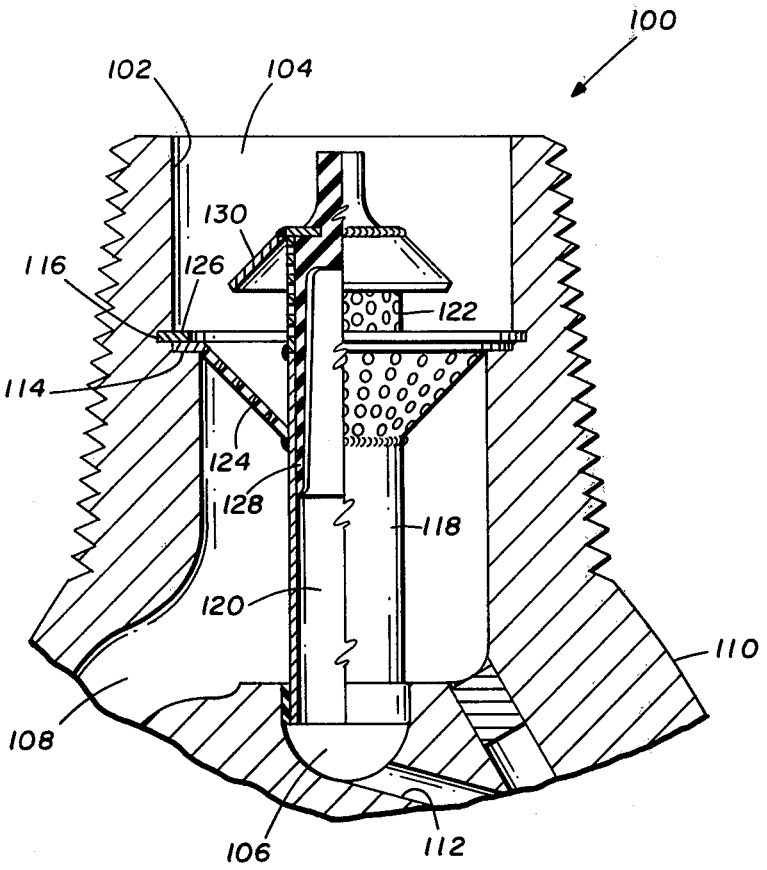
FIG. 4 illustrates another embodiment of a bit constructed according to the present invention.

Referring now to FIG. 4, another embodiment of a bit constructed in accordance with the present invention is illustrated. The bit is generally designated by the reference character 100. The bit 100 includes a centrally located recess 102 that is divided into an upper chamber 104 and a lower chamber 106. A plurality of jet passageways 108 extend downwardly through the body 110. The lower ends of the jet passageways 108 are located between adjacent cutters. A plurality of cooling passageways 112 extend through the body 110 intersecting the lower chamber 106 and terminating adjacent the various bearing surfaces of the spindle. The cooling passageways 112 are provided to direct a portion of the circulating air or gas utilized in the drilling process into the bearing surfaces for the purpose of cooling the bearings.

The body 110 of the bit 100 has an upwardly facing shoulder 114 encircling the recess 102 in the upper chamber 104. An annular groove 116 also encircles the recess 102 above the shoulder 116 and in spaced relation thereto. A centrally located hollow member 118 has its lower end disposed in the lower chamber 106 and has an interior 120 in communication with the cooling passageways 112 through the lower chamber 106. The lower end of the hollow member 118 is in sealing engagement with the body 110. The upper end of the hollow member 118 is provided with a perforated cap 122. This provides a screen to prevent the entrance of relatively large pieces into the interior 120 of the hollow member 118. A perforated member 124 is positioned around the hollow member 118. The perforated member 124 is frusto-conical in configuration having its inner periphery attached to the hollow member and having its outer periphery disposed in engagement with a lock ring 126. The perforated member thus provides a screen to prevent the entrance of relatively large particles into the jet passageways 108. A resilient member 128 is positioned within the perforated cap 122. The resilient member 128 is easily deformed or moved away from the perforated cap 122 by fluid flowing downwardly through the upper chamber 104 in the bit 100. Any flow in the opposite direction will cause the resilient member 128 to close the perforations in perforated cap 122 and block flow of any fluid upwardly. A conical cover 130 is positioned over the perforated cap 122. This causes the air to change direction before it enters the perforated cap 122 and hollow member 118. The change of direction acts to separate water from the circulating air and prevent any water entrained with the circulating air from entering the bearings.

The structural details of another embodiment of a bit constructed in accordance with the present invention having been described, the operation of the bit 100 will now be considered. After the perforated members 122 and 124 and hollow member 118 are assembled, they are inserted into the recess 102 in the body 110 until the screen 124 engages the upwardly facing shoulder 114. The lock ring 126 is then inserted to secure the perforated screen 124 and hollow member 118 in the body 110. The bit 100 is connected to the lower end of a rotary drill string (not shown). The bit 100 and drill string are lowered into the well bore (not shown) and rotated by the drill string forcing the cutters into engagement with the bottom of the borehole. Drilling fluid is circulated downwardly through the drill string into the recess 102. The air passes through the perforations in cap 122 deforming the resilient member 128. The conical cover 130 causes the circulating air to change directions and remove any entrained water. This insures that only dry air will reach the bearings. The air continues into the interior 120 of the hollow member 118 to the cooling passageways 112 and the various bearings journaling the cutters on the spindles. It should be emphasized that the central location of a hollow member 118 places it in the center of the air stream wherein the air velocity is at a maximum. Such a location insures that the bearings will receive the optimum quantity of cooling air. Also, a portion of the air passes through the perforations in the perforated member 124 into the jet passageways 108. The air exiting from the jet passageways pass through the nozzles and is directed to the bottom of the well bore. The circulating air entrains the cuttings from the well bore and carries them upwardly between the wall of the well bore and the exterior of the bit and the drill string.

If a water bearing formation is encountered during the drilling of the borehole, the water will migrate into the well bore when the circulation of air is stopped. The water will rise in the borehole and completely surround the bit. If the water was not otherwise restricted, it would migrate through the journals of the cutters passing upwardly through the cooling passageways into the interior of the hollow member. The rubber bladder seal/valve assembly provides a flow control valve to prevent the flow of water into the bit. When the circulating air is turned off the pressure within the bit drops. The borehole pressure being greater than the pressure within the bit tends to move water and cuttings into the bearing cavities. The borehole pressure forces the resilient member 128 to seal off the water. Since the borehole pressure is greater than the pressure within the bit 100 due to the head of ground water in the borehole, the seal against the perforated element 122 is strong and sufficiently effective to seal off passage of air back into the bit thus creating air pockets that will contain and prevent the ground water from entering the bearing cavities. It is expected that some small amount of water and cuttings may enter the lower extremeties of the bearing cavities, but with positive air seals on all the openings into the bit this encrouchment should be minor and easily expelled when the circulating air is restarted.

Figure 5:
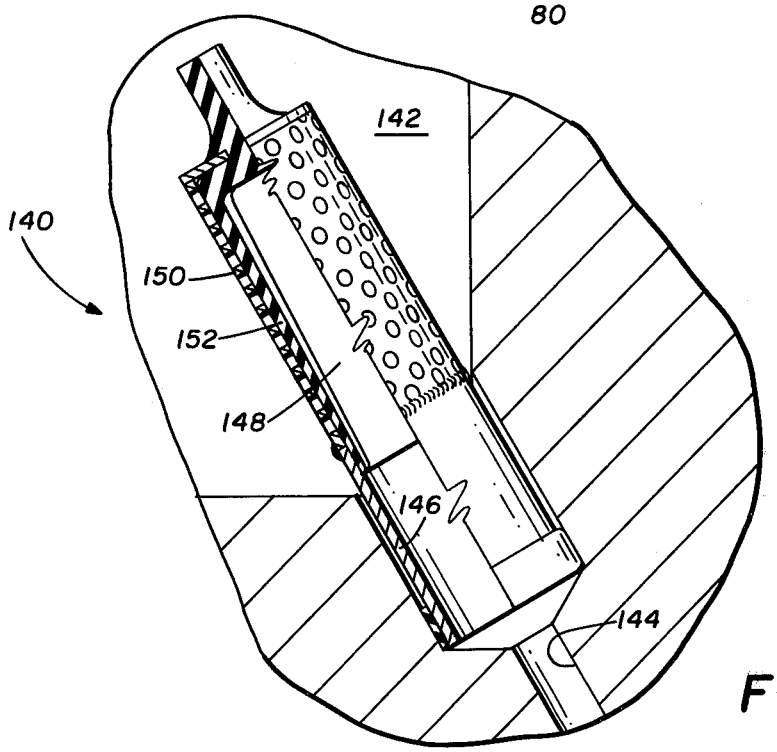
FIG. 5 illustrates yet another embodiment of a bit constructed according to the present invention.

Referring now to FIG. 5, another embodiment of a bit constructed in accordance with the present invention is illustrated. The bit 140 includes a centrally located recess 142. A plurality of cooling passageways extend through the body of the bit intersecting the recess 142 and terminating adjacent the various bearing surfaces of the bit. The cooling passageways 144 are provided to direct a portion of the circulating air or gas utilized in the drilling process into the bearing surfaces for the purpose of cooling the bearings. A hollow member 146 has an interior 148 in communication with the cooling passageways 144. The upper end of the hollow member 146 is provided with a perforated cap 150. This provides a screen to prevent the entrance of relatively large pieces into the hollow member 146. A resilient member 152 is positioned within the perforated cap 150. The resilient member 152 is easily deformed or moved away from the perforated cap 150 by fluid flowing downwardly through the bit. Any flow in the opposite direction will cause the resilient member to close the perforations in perforated cap and block flow of any fluid upwardly.

The structural details of another embodiment of a bit constructed in accordance with the present invention having been described, the operation of the bit 140 will now be considered. The bit 140 is connected to the lower end of a rotary drill string (not shown). The bit and drill string are lowered into the well bore (not shown) and rotated by the drill string forcing the cutters into engagement with the bottom of the borehole. Drilling fluid is circulated downwardly through the drill string. The air passes through the perforations in cap 150 deforming the resilient member 152. The air continues into the interior of the hollow member 146 to the cooling passageways 144 and the various bearings journaling the cutters on the spindles. The present invention provides valve means for controlling the entry of water into the bearings. The stream of air or gas is directed through a valve system to prevent water from reaching the bearings. A shut-off valving arrangement through the bearing passageways provides a means for more effectively preventing water and cuttings from entering the bearings and bearing passageways of the bit. The borehole pressure forces the resilient member 152 to seal off the water. Since the borehole pressure is greater than the pressure within the bit due to the head of ground water in the borehole, the seal against the perforated element 150 is strong and sufficiently effective to seal off passage of air back into the bit thus creating air pockets that will contain and prevent the ground water from entering the bearing cavities. It is expected that some small amount of water and cuttings may enter the lower extremeties of the bearing cavities, but with positive air seals on all the openings into the bit this encrouchment should be minor and easily expelled when the circulating air is restarted.

The embodiments of the invention in which an exclusive property of privilege is claimed are defined as follows:

1. A drill bit for air drilling, comprising:

a body;

a plurality of cutter means journaled on said body;

a recess in said body forming a chamber;

a plurality of jet passageways intersecting said chamber and oriented to direct a jet of air between adjacent cutter means;

a cooling passageway for each of said cutter means intersecting said chamber and arranged to discharge air into the journals for said cutter means;

a hollow member disposed substantially coaxially in said recess and having an open lower end in substantial sealing engagement with said body providing communication between the interior of said recess and said cooling passageways, said hollow member having its upper end perforated forming a screen;

a resilient member disposed within said hollow member in juxtaposition with said screen and being movable away from said screen to permit flow therethrough into said cooling passageways and movable toward said screen to substantially prevent flow from said cooling passageway therethrough;

a conical cover connected to said hollow member and positioned over said perforated upper end of said hollow member for causing air to change direction before it enters the perforated upper end of said hollow member; and a perforate member of frusto-conical configuration located in said upper chamber encircling said hollow member, said perforate member having its inner periphery connected with said hollow member relatively below said screen and having its outer periphery disposed relatively above said inner periphery in engagement with said body in the upper chamber and above the intersections of said jet passageways with said upper chamber.

2. A drill bit for air drilling, comprising:

a body;

a plurality of cutter means journaled on said body;

a recess in said body forming upper and lower chambers;

a plurality of jet passageways extending therethrough intersecting said upper chamber and oriented to direct a jet of air between adjacent cutter means;

a cooling passageway extending therethrough for each of said cutter means intersecting said lower chamber and arranged to discharge air into the journals for said cutter means;

a hollow member disposed substantially coaxially in said recess and having an open lower end located in said lower chamber in substantial sealing engagement with said body providing communication between the interior of said hollow member and said cooling passageways, said hollow member having its upper end perforated forming a screen;

a first resilient member disposed within said hollow member in juxtaposition with said screen and being movable away from said screen to permit flow therethrough into said cooling passageways and movable toward said screen to substantially prevent flow from said cooling passageway therethrough;

a perforate member of frusto-conical configuration located in said upper chamber encircling said hollow member, said perforate member having its inner periphery connected with said hollow member relatively below said screen and having its outer periphery disposed relatively above said inner periphery in engagement with said body in the upper chamber and above the intersections of said jet passageways with said upper chamber; and a conical cover disposed in contact with said hollow member and positioned over said perforate upper end of said hollow member for causing air to change direction before it enters the perforated upper end of said hollow member.

* * * * *